US012484676B1

(12) United States Patent
Shakhbazyan

(10) Patent No.: US 12,484,676 B1
(45) Date of Patent: Dec. 2, 2025

(54) DEVICE TO ASSIST WITH HAIR COLORING/FOIL HIGHLIGHTS AND METHOD OF MANUFACTURING THE DEVICE

(71) Applicant: Khachatur Shakhbazyan, Brooklyn, NY (US)

(72) Inventor: Khachatur Shakhbazyan, Brooklyn, NY (US)

( * ) Notice: Subject to any disclaimer, the term of this patent is extended or adjusted under 35 U.S.C. 154(b) by 0 days.

(21) Appl. No.: 19/074,574

(22) Filed: Mar. 10, 2025

Related U.S. Application Data

(60) Provisional application No. 63/724,362, filed on Nov. 24, 2024.

(51) Int. Cl.
*A45D 19/00* (2006.01)

(52) U.S. Cl.
CPC ..... *A45D 19/018* (2021.01)

(58) Field of Classification Search
CPC .. A45D 19/0066; A45D 19/00; A45D 19/016; A45D 19/012; A45D 19/018
See application file for complete search history.

(56) References Cited

U.S. PATENT DOCUMENTS

| | | | | |
|---|---|---|---|---|
| 6,237,608 | B1 * | 5/2001 | Kari | A45D 19/012 132/200 |
| 8,142,341 | B1 * | 3/2012 | Salvesen | B65H 35/002 493/356 |
| 2003/0150468 | A1 * | 8/2003 | Polesuk | A45D 19/018 132/222 |
| 2008/0222894 | A1 * | 9/2008 | Borenslein | B26D 5/26 30/43.92 |
| 2015/0320170 | A1 * | 11/2015 | Anderson | A45D 19/016 132/208 |
| 2022/0248829 | A1 * | 8/2022 | Williams | B65H 35/008 |
| 2022/0346517 | A1 * | 11/2022 | Kelly | A45D 19/018 |

* cited by examiner

*Primary Examiner* — Javier A Pagan

(57) ABSTRACT

The present invention relates to a hair coloring assistance device including a foil strip holder, a color board interface extension region with two magnetic regions and base. A color board having at least two magnetic areas on a bottom surface of the color board interfaces with the foil strip holder and engage with the color board interface extension region with the magnetic regions. A plurality of foil strips is placed onto the foil strip holder and the color board is placed onto the color board interface extension region. The color board when placed onto the hair styling assistance device, the magnetic regions of the foil strip holder engage with the magnetic areas of the color board, enabling a hair styling professional to execute a single-handed operation of placement of a single foil strip placed onto the foil strip holder onto the color board for use during hair coloring processes.

15 Claims, 12 Drawing Sheets

FIG.9A-C

DEVICE TO ASSIST WITH HAIR COLORING/FOIL HIGHLIGHTS AND METHOD OF MANUFACTURING THE DEVICE

CLAIM FOR PRIORITY

This application claims priority from a prior utility provisional application with application No. 63/724,362 filed on Nov. 24, 2024. The entire collective teachings thereof being herein incorporated by reference.

FIELD OF THE INVENTION

This invention generally relates to the field of hair treatment and cosmetology, specifically to hair coloring and highlighting tools. More particularly, the invention pertains to a hair coloring assistance device suitable for assisting in hair coloring and foil highlighting processes configured for functionality for a one hand operation.

BACKGROUND OF THE INVENTION

Coloring or highlighting hair is frequently used as part of routine hair styling. There are several types of color and highlights applications, which are typically done with a lighter hair color (pigment) than a person's natural hair color, hydrogen peroxide for very light (blond or platinum) highlights, or a mixture of a hair color and hydrogen peroxide for something in the middle. A similar process is used to apply darker colors than the person's natural hair color.

The current state of the art has been the same for decades. The hair stylist utilizes a long, typically rectangular board, upon which an assistant must lay out a long strip of foil of corresponding size to prepare the board for application of the hair color and/or hydrogen peroxide. The board could be 5-6 inches in width and 8-15 inches in length, but other sizes are also available. The standard sizes of the board are usually 5×8 inches, 5×11 inches, and 5×15 inches, which, not coincidentally, are approximately the same as the standard sizes of foils available for foil highlights. The lengths of the board and corresponding foils selected for highlights are usually dictated by the length of the hair. The strip of foil is usually also rectangular in shape, and one of the shorter sides of the rectangle is typically folded over the corresponding short edge of the board to prepare for the application of color and to protect the board from coming in contact with the chemical coloring agents because otherwise the edge of the board may transfer the color to adjacent hair and ruin the effect. The hair stylist separates the hair on a head into sections, and further separates the hair into strands of appropriate size to apply the hair color and/or hydrogen peroxide to create the highlighting effect. The separation is usually done with the handle part of the brush for applying the color, which is usually plastic and in the shape of a pick. Depending on the application, the effect may be softer, or more natural, almost imperceptible in color change from the person's natural hair color, or the effect can generate pronounced highlights. The assistant passes the board to the hair stylist when the stylist is ready to apply the hair color and/or hydrogen peroxide to a particular strand. The hair stylist places the separated hair strand onto the foil, overlaid flat on the board for even support. The end of the board that has a folded-over edge of the foil is held closest to the person's head and may be in contact with the person's scalp. The hair stylist then applies the hair color and/or hydrogen peroxide to the hair strand on top of the foil, usually with a brush, covering the entire strand down to the hair roots. After the application, the hair stylist folds or otherwise fixes the shape of the foil to ensure the hair strand and the chemicals on it do not come into contact with the nearby hair. The process is then repeated as needed with additional hair strands, to create a unique highlighted look for an individual. This method ensures that only the selected and parted out hair strands receive the color, and the remaining hair is not affected by color.

After completing the color application for each hair strand, the hair stylist must pass the board back to the assistant to overlay another piece of foil for the next hair strand and to bend the side of the foil strip over the edge of the board. The hair stylist cannot easily complete this process because it requires both hands, but the hair stylist applying the color with a brush almost inevitably transfers some color to the hair stylist's hands, which are typically gloved. If the hair stylist attempts to set the foil on the board and fold the foil over the edge of the board, the hair stylist will likely transfer some of the hair color onto the board and/or the foil, thus jeopardizing the clean look of the finished hair style when this color gets all over the board and transfers the color to hair that was not intended to be given color or highlights. The effect is such that either the hair stylist must keep an assistant to help with setting up the board for each hair strand, making the process more expensive for the hair stylist and therefore the end consumer, or the hair stylist must try to set the board each time and try not to fumble the application of the color.

Therefore, there is a need for an improved hair coloring assist device that enables a hair stylist to perform the process of coloring or highlighting hair, alone, without an assistant, by operating the board and setting strips of aluminum foil with one hand that improves and speeds up the process and makes it less expensive.

BRIEF SUMMARY OF THE INVENTION

The present invention provides a hair coloring assistance device suitable for assisting in hair coloring and foil highlighting processes configured for functionality for a one hand operation. The device comprises a foil strip holder having a substantially U-shaped cross-section with a flat bottom, a top surface, two opposing walls extending vertically from the flat bottom, and a color board interface extension region with two magnetic regions. The color board interface extension region is configured with two foil strip stops positionable on a top surface. A color board is configured to interface with the foil strip holder and arranged to be positionable on the top surface area of the foil strip holder and to engage with the color board interface extension region of the foil strip holder with the magnetic regions. The color board includes at least two magnetic areas on a bottom surface of the color board that are dimensionally configured to align with the two magnetic regions on the top surface of the foil strip holder.

When a plurality of foil strips is placed onto the foil strip holder and the color board is placed onto the color board interface extension region, the plurality of foil strips is interspersed between a top surface of the foil strip holder and the bottom surface of the color board and the plurality of foil strips are maintained onto a position on the hair coloring assistance device by the structure of the two foil strip stops. The color board when placed onto the hair styling assistance device, the magnetic regions of the foil strip holder engage with the magnetic areas of the color board, enabling a hair styling professional to execute a single-handed operation of placement of a single foil strip of the plurality of foil strips placed onto the foil strip holder onto the color board for use during hair coloring processes.

In an embodiment, a wedge is configured to be positioned on the top surface of the foil strip holder structured to provide an angle from a horizontal angle and arranged to allow the hair stylizing professional to manually grab a single foil strip from the plurality of foil strips and with a one hand operation fold an end of the single foil strip over an end of the color board.

In another embodiment, a stopper is located at a first end of the foil strip holder to prevent downward sliding of the board and/or a stack of foil strips placed on the foil strip holder and an adjustment mechanism configured to regulate the position of the wedge, the board, or both, to accommodate varying lengths of the plurality of foil strips and for a plurality of color board dimensions.

In yet another embodiment, the foil strip holder includes a movable tongue configured to adjustably protrude from the flat bottom to accommodate boards of different lengths.

In yet another embodiment, the tongue adjustment mechanism comprises a series of notches, teeth, or self-locking latches allowing movement in both directions.

In yet another embodiment, the wedge is removably attached to the foil strip holder using hook-and-loop fasteners or similar attachment means.

In yet another embodiment, the board includes two or more magnetic attachments, with a first magnetic attachment located near an upper lateral edge of the board and a second magnetic attachment positioned lower than the first magnetic attachment.

In yet another embodiment, the magnetic attachments on the board and the wedge are configured to selectively attach to each other at multiple positions to adjust the height of the board within the board holder.

In yet another embodiment, the device includes a base attached to the bottom of the board holder. The base is configured to pivot around a vertical axis.

In yet another embodiment, the base includes height adjustment mechanisms to elevate or lower the board holder.

In yet another embodiment, the base is removable and includes suction cups, felt pads, magnetic connection devices, adhesives, locking surface devices, or sliding pads to secure or protect the surface on which the foil strip holder is placed.

In yet another embodiment, the wedge includes multiple angled surfaces, allowing for reversible positioning to provide different angles of tilt for the board.

In yet another embodiment, the board holder, the wedge, and the board are constructed from a lightweight, washable, and chemical-resistant materials, selected from carbon fiber, plastic, plexiglass, or wood.

In yet another embodiment, the foil strip holder includes adjustable walls to accommodate boards of varying widths.

In yet another embodiment, the device further comprises legs or supports attached to the board holder, the legs or supports configured to include suction cups, felt pads, or wheels.

In yet another embodiment, the legs or supports include at least three wheels, with at least one wheel being pivotable.

In yet another embodiment, the board includes repositionable magnetic attachments configured to be adjusted along the board using a hook-and-loop mechanism.

In yet another embodiment, the wedge is configured with an adjustable angle to regulate the tilt of the board and the stack of foil sheets during use.

In yet another embodiment, the wedge is sized to substantially fill the space between the opposing walls of the board holder, limiting lateral movement of the wedge.

In yet another embodiment, the device includes attached cup holders for positioning chemical mixing cups utilized during a hair coloring process.

In yet another embodiment, the device comprises a three-dimensional alignment, three-dimensional rotation, and three-dimensional axis rotation mechanism. The hair coloring assistance device can be adjusted manually for height, angle, pitch, and rotation by the hair styling professional.

The hair coloring assist device is designed specifically for individuals with longer hair, as foil highlights are typically used for this hair length. One of its key advantages is that it allows hairstylists to work independently, eliminating the need for an assistant. This not only makes the process faster but also significantly reduces costs for consumers by minimizing labor expenses. Additionally, the device helps ensure precision and consistency, leading to more professional results while streamlining the overall workflow. By offering a time-saving and cost-effective solution, this innovation enhances both the hairstylist's efficiency and the client's experience.

The embodiments covered by this patent are defined by the claims. The summary above provides a general overview of various aspects and introduces some of the concepts that are discussed in greater detail in the following description section. This summary is not meant to identify the key or essential features of the claimed subject matter, nor is it intended to be used on its own to determine the scope of the claims. The subject matter should be understood with reference to the entire specification, including any relevant drawings and the claims themselves.

BRIEF DESCRIPTION OF THE DRAWINGS

A clear understanding of the key features of the invention summarized above may be had by reference to the appended drawings, which illustrate the method and system of the invention, although it will be understood that such drawings depict preferred embodiments of the invention and, therefore, are not to be considered as limiting its scope with regard to other embodiments which the invention is capable of contemplating. Accordingly.

Like reference numerals refer to like parts throughout the several views of the drawings.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion.

Nevertheless, the specification and claims should be read with the understanding that such combinations are entirely within the scope of the invention and the claims. A hair coloring assistance device is discussed herein. In the following description, for purposes of explanation, numerous specific details are set forth in order to provide a thorough understanding of the present invention. It will be evident, however, to one skilled in the art that the present invention may be practiced without these specific details. The present disclosure is to be considered as an exemplification of the invention and is not intended to limit the invention to the specific embodiments illustrated by the figures or description below. The present invention will now be described by referencing the appended figures representing preferred embodiments.

Figure 1:
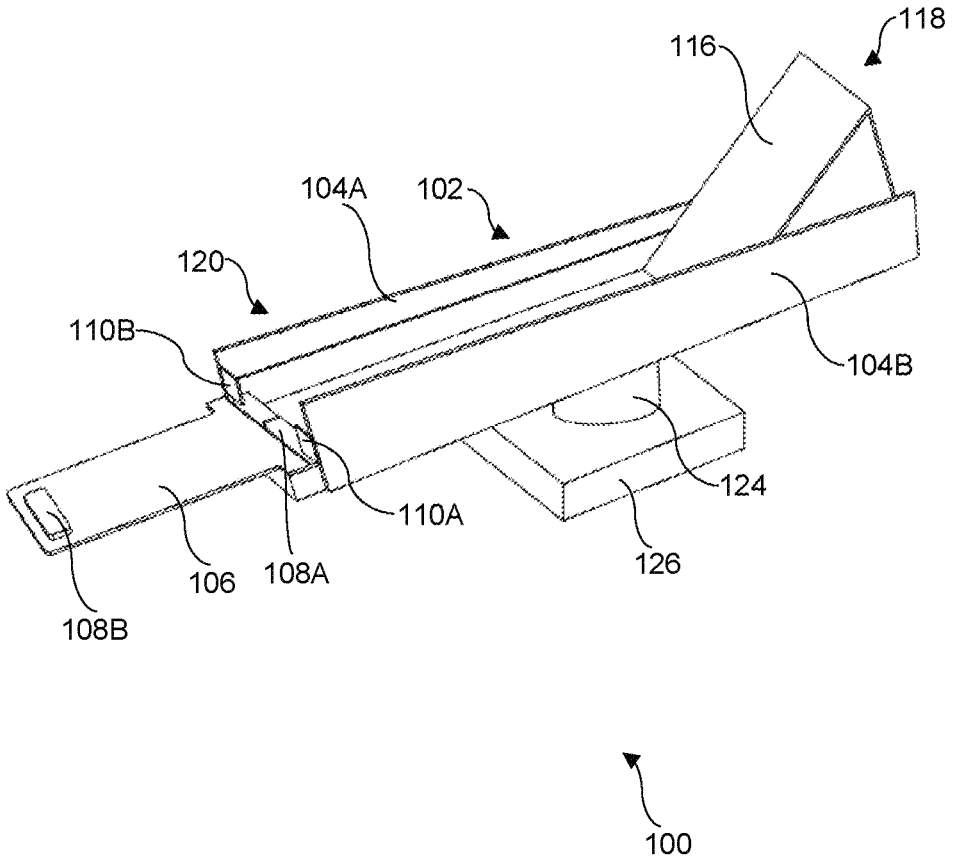
FIG. 1-FIG. 1 illustrates a right perspective view of the hair coloring assistance device according to various embodiments of the present invention.

FIG. 1 illustrates a right perspective view of the hair coloring assistance device according to various embodiments of the present invention. The hair coloring assistance device 100 of FIG. 1 includes a foil strip holder 102 having a substantially U-shaped cross-section with a flat bottom, a top surface, and two opposing walls 104A-B extending vertically from the flat bottom.

The device 100 includes a color board interface extension region 106 provided with two magnetic regions 108A-B, and configured with two foil strip stops 110A and B positionable on a top surface. The device 100 includes a color board 112 (Not shown in FIG. 1) configured to interface with the foil strip holder 102. The color board 112 is arranged to be positionable on the top surface area of the foil strip holder 102 and to engage with the color board interface extension region 106 of the foil strip holder 102 with the magnetic regions 108A-B and having at least two magnetic areas 114A-B on a bottom surface of the color board 112. The at least two magnetic areas 114A-B are dimensionally configured to align with the two magnetic regions 108A-B on the top surface of the foil strip holder 102. When a plurality of foil strips is placed onto the foil strip holder 102 and the color board 112 is placed onto the color board interface extension region 106, the plurality of foil strips is interspersed between a top surface of the foil strip holder 102 and the bottom surface of the color board 112. The plurality of foil strips is maintained onto a position on the hair coloring assistance device 100 by the structure of the two foil strip stops 110 A and B. The color board 112 when placed onto the hair styling assistance device 100, the magnetic regions 108A-B of the foil strip holder 102 engage with the magnetic areas 114A-B of the color board 112 facilitating a hair styling professional to execute a single-handed operation of placement of a single foil strip of the plurality of foil strips placed onto the foil strip holder 102 onto the color board 112 for use during hair coloring processes.

The hair coloring assistance device 100 includes a wedge 116 configured to be positioned on the top surface of the foil strip holder 102 at a second end 118. The wedge 116 is structured to provide an angle from a horizontal angle and arranged to allow the hair stylizing professional to manually grab a single foil strip from the plurality of foil strips and with a one hand operation, fold an end of the single foil strip over an end of the color board. The wedge 116 includes a bottom part, a top part, and an angle of tilt between the bottom part and the top part. The top part includes at least one magnetic attachment configured to cooperate with the at least one magnetic attachment on the color board 112. A stopper is located at a first end 120 of the foil strip holder to prevent downward sliding of the board 112 and/or a stack of foil strips placed on the board holder. The device 100 may include an adjustment mechanism configured to regulate the position of the wedge 116, the board 112, or both, to accommodate varying lengths of the plurality of foil strips and for a plurality of color board dimensions. The wedge 116 may be configured with an adjustable angle to regulate the tilt of the board 112 and the stack of foil strips during use. The wedge 116 is sized to substantially fill the space between the opposing walls 104A-B of the foil strip holder 102, limiting lateral movement of the wedge 116.

The foil strip holder 102 may include a movable tongue configured to adjustably protrude from the flat bottom to accommodate color boards 112 of different lengths. The tongue adjustment mechanism comprises a series of notches, teeth, or self-locking latches allowing movement in both directions. The wedge 116 may be removably attached to the foil strip holder 102 using hook-and-loop fasteners or similar attachment means. The wedge 116 may include multiple angled surfaces, allowing for reversible positioning to provide different angles of tilt for the color board 112.

The color board 112 may include two or more magnetic attachments 122A-B (Not shown in FIG. 1), with a first magnetic attachment 122A located near an upper lateral edge of the board 112 and a second magnetic attachment 122B positioned lower than the first magnetic attachment 122A. The magnetic attachments 122A-B on the color board 112 and the at least one magnetic attachment of the wedge 116 are configured to selectively attach to each other at multiple positions to adjust the height of the color board 112 within the foil strip holder 102.

The device 100 further includes a base 124 attached to the bottom of the foil strip holder 102. The base 124 is configured to pivot around a vertical axis. The base 124 may include height adjustment mechanisms to elevate or lower the foil strip holder 102. The base 124 may be removable and may include suction cups, felt pads, magnetic connection devices, adhesives, locking surface devices or sliding pads to secure or protect the surface 126 on which the foil strip holder 102 is placed. The foil strip holder 102, the wedge 116, and the color board 112 are constructed from a lightweight, washable, and chemical-resistant materials, selected from carbon fiber, plastic, plexiglass, or wood. The device 100 may further comprise legs or supports attached to the foil strip holder 102 and the legs or supports are configured to include suction cups, felt pads, or wheels. The legs or supports may include at least three wheels, with at least one wheel being pivotable. The device 100 may include attached cup holders for positioning chemical mixing cups utilized during a hair coloring process. The color board 112 may include repositionable magnetic attachments configured to be adjusted along the board 112 using a hook-and-loop mechanism. The wedge 116 is configured with an adjustable angle to regulate the tilt of the color board 112 and the stack of foil sheets during use. The wedge 116 is sized to substantially fill the space between the opposing walls of the foil strip holder 102 limiting lateral movement of the wedge 116. In one embodiment, the length of the foil strip holder 102 include a length of 15 or 16 inches, a width of 5¼ inches. The height at the first end of the foil strip holder 102 includes 1 ½ inches and the at the second end of the foil strip holder 102 includes 4 inches. In one embodiment, the width of the color board interface extension region 106 include 4¾ inches or 4 ½ inches. The device includes a three-dimensional alignment, three-dimensional rotation, and three-dimensional axis rotation mechanism 200A. The hair coloring assistance device 100 can be adjusted manually for height, angle, pitch, and rotation by the hair styling professional with the three-dimensional axis rotation mechanism 200A.

Figure 2:
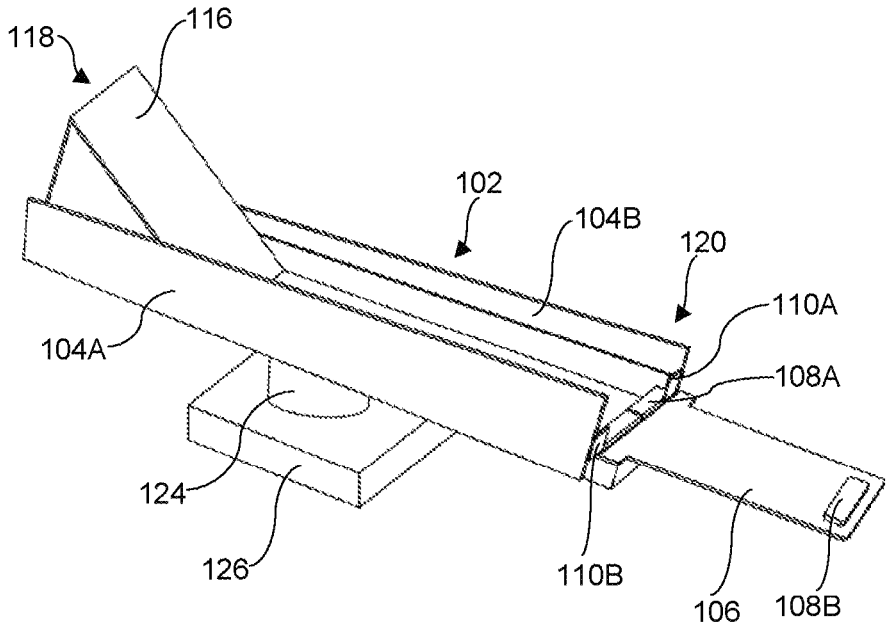
FIG. 2-FIG. 2 illustrates a left perspective view of the hair coloring assistance device of FIG. 1 according to various embodiments of the present invention.

FIG. 2 illustrates a left perspective view of the hair coloring assistance device of FIG. 1 according to various embodiments of the present invention. The hair coloring assistance device of FIG. 2 shows the foil strip holder 102, the two opposing walls 104A-B, the color board interface extension region 106, the two magnetic regions 108A-B, the wedge 116, the second end 118 of foil strip holder 102, the first end 120 of foil strip holder 102, the base 124 and the support 126. The functioning of the components is described in FIG. 1.

Figure 3:
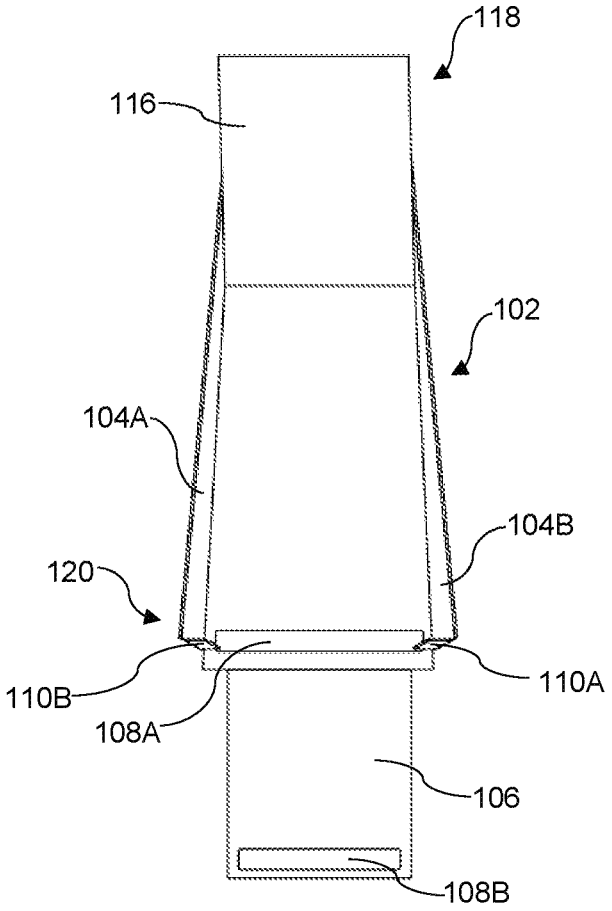
FIG. 3-FIG. 3 illustrates a top view of the foil strip holder of the hair coloring assistance device of FIG. 1 according to various embodiments of the present invention.

FIG. 3 illustrates a top view of the foil strip holder of the hair coloring assistance device of FIG. 1 according to various embodiments of the present invention. FIG. 3 shows the foil strip holder 102 including the two opposing walls 104A-B, the color board interface extension region 106, the two magnetic regions 108A-B, the wedge 116, the second end 118 of foil strip holder 102, the first end 120 of foil strip holder 102. The functioning of the components is described in FIG. 1. The length of the foil strip holder is 15 inches with a width of 51/4 inches.

Figure 4:
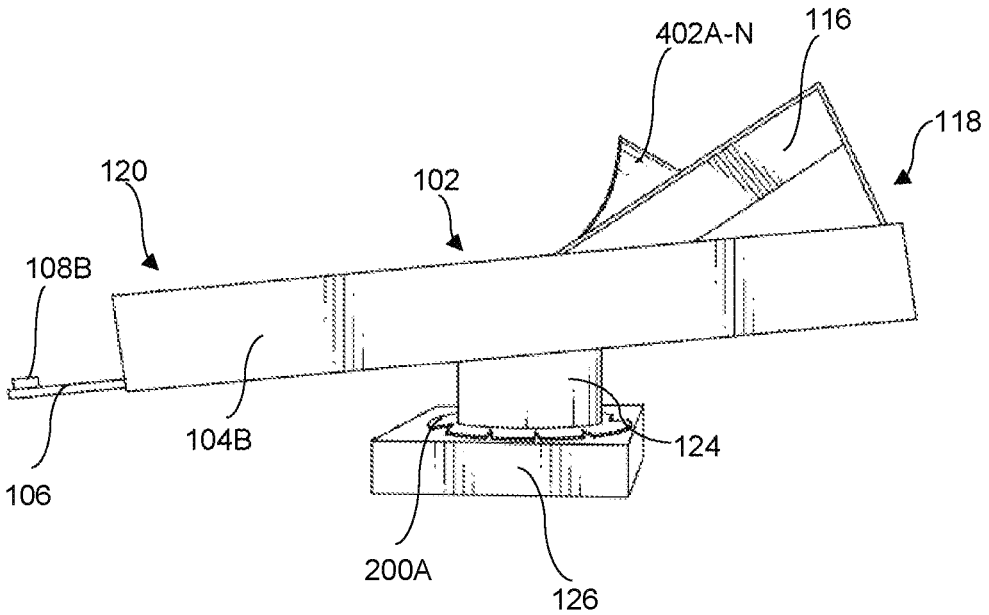
FIG. 4-FIG. 4 illustrates the hair coloring assistance device of FIG. 1 with the plurality of foil strips placed on the foil strip holder according to various embodiments of the present invention.

FIG. 4 illustrates the hair coloring assistance device of FIG. 1 with the plurality of foil strips placed on the foil strip holder according to various embodiments of the present invention. FIG. 4 shows the foil strip holder 102, the opposing walls 104B, the color board interface extension region 106, the magnetic region 108B, the wedge 116, the second end 118 of foil strip holder 102, the first end 120 of foil strip holder 102, the base 124 and the support 126. FIG. 4 shows the plurality of foil strips 402A-N placed onto the foil strip holder 102.

Figure 5:
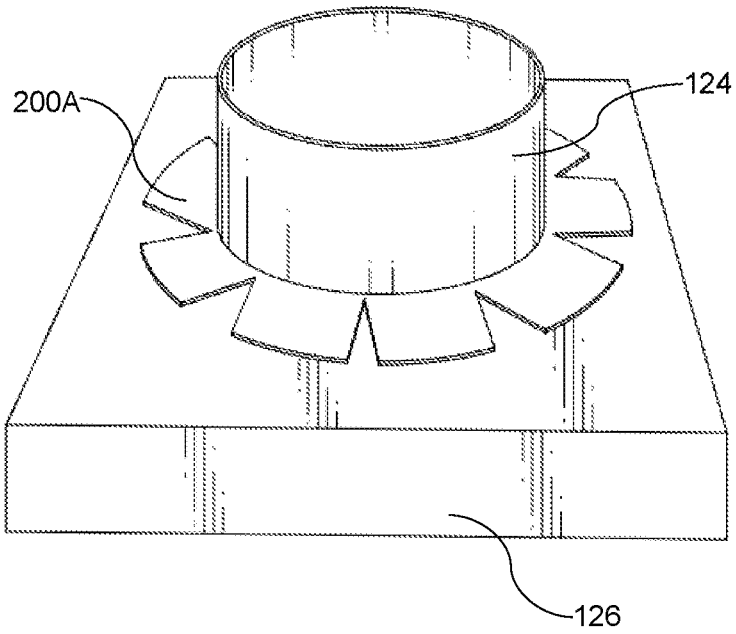
FIG. 5-FIG. 5 illustrates the base of the hair coloring assistance device of FIG. 1 according to various embodiments of the present invention.

FIG. 5 illustrates the base of the hair coloring assistance device of FIG. 1 according to various embodiments of the present invention. The base 124 may include suction cups, felt pads, magnetic connection devices, adhesives, locking surface devices, or sliding pads to secure or protect the surface 126 on which the foil strip holder 102 is placed. In an embodiment, the support 126 have suction cups allowing a smaller version of the base 124 to be positioned on top of a small table.

Figure 6:
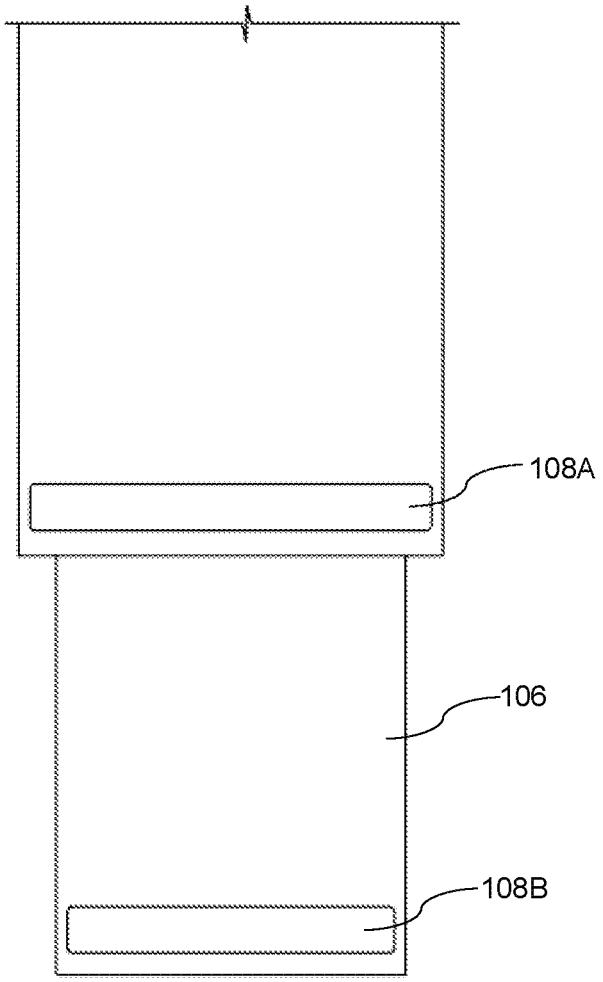
FIG. 6-FIG. 6 illustrates a top view of the color board interface extension region of the foil strip holder with the two magnetic regions of FIG. 1 according to various embodiments of the present invention.

FIG. 6 illustrates a top view of the color board interface extension region of the foil strip holder with the two magnetic regions of FIG. 1 according to various embodiments of the present invention. The two magnetic regions 108A-B have been field-tested for dimensions and spacing, specifically the width of the top and bottom magnetic regions. The two magnetic regions 108A-B have been field-tested for the width and the thickness as well as the height of each of the two magnetic regions 108A-B. Additionally, the distance between the two magnetic regions 108A-B on the top surface of the color board interface extension region 106 have been field-tested and determined to be optimum to allow the color board 112 to interface with the color board interface extension region 106 in order to properly engage with the color board 112 in order to sandwich or maintain the strips of foil between the color board interface extension region 106 and the color board 112.

Figure 7:
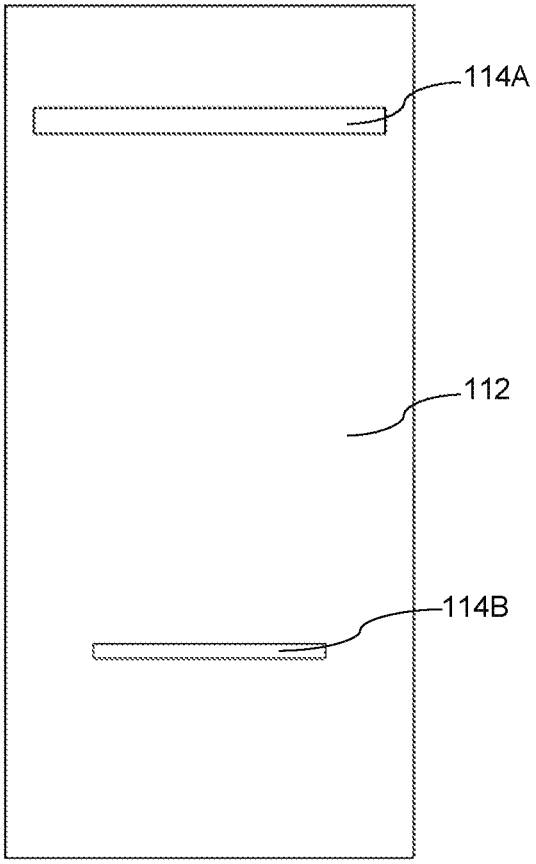
FIG. 7-FIG. 7 illustrates a top view of the color board of FIG. 1 according to various embodiments of the present invention.

FIG. 7 illustrates a top view of the color board of FIG. 1 according to various embodiments of the present invention. The color board 112 is configured with two magnetic areas 114A-B on a bottom surface of the color board 112. The field test is determined for thickness of each of the magnetic areas 114A-B, the height of the different areas and the width in order to allow the color board 112 to properly engage with the foil strip holder 102 and to maintain the color board 112 in place and to sandwich the plurality of foil strips.

Additionally, the distance between the two magnetic areas or magnetic areas 114A-B in the bottom surface of the color board 112, are dimensionally aligned to mate with dimensions between the two magnetic regions 108A-B on the top surface of the color board interface extension region 106. when the color board 112 is placed on top of the foil strip over, the two magnetic areas 114A-B of the color board engage with the two magnetic regions 108A-B of the color board extension region 106 of the foil strip portal.

Figure 8A:
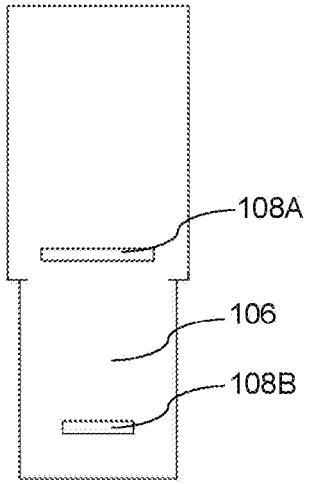
FIGS. 8A-C-FIGS. 8A-C illustrate progression of the color board moving over on top of the color board interface extension region of FIG. 1 according to various embodiments of the present invention.
Figure 8B:
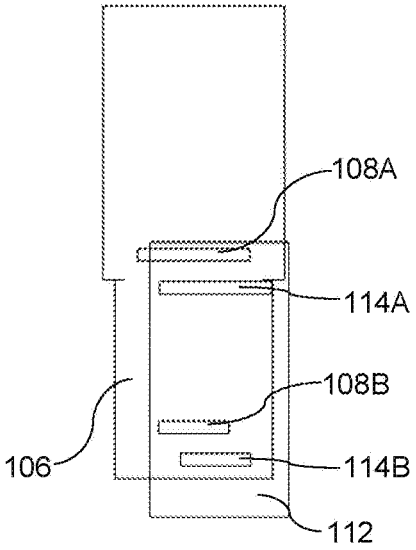
Figure 8C:
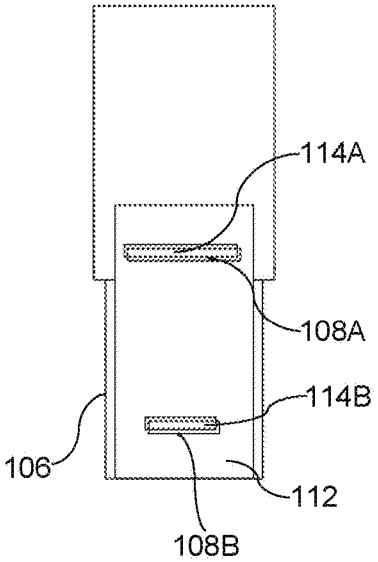

FIGS. 8A-C illustrate progression of the color board moving over on top of the color board interface extension region of FIG. 1 according to various embodiments of the present invention. FIGS. 8A-C shows how the magnetic areas 114A-B on the bottom of the surface of the color board 112 align and mate or interact with the two magnetic regions 108A-B of the color board interface extension region 106 of the foil strip holder 102. As can be seen from FIGS. 8A, 8B, and 8C the two foil strip stops 110A and B are configured in such a way to allow the color board 112 itself to fit within the dimensions of the foil strip holder 102 with the foil strip stops 110A and B so that it fits between the extensions of the two foil strip stops 110 A and B so that the foil strip stops 110A and B are both angled at 90 degrees and configured to hold the plurality of foil strips in place, but allow the color board 112 to go over the plurality of foil strips and then position itself so that the two magnetic areas 114A-B on the bottom surface of the color board 112 interface and mate with the two magnetic regions 108A-B of the color board interface extension region 106.

Figure 9A:
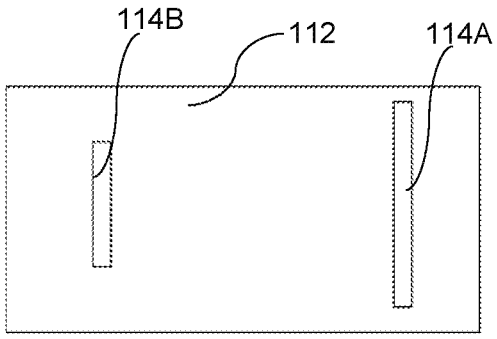
FIGS. 9A-C-FIGS. 9A-C shows a top view of the color board, a side view of the color board and a side view of the foil strip holder with the two magnetic regions on the colored board interface extension region of FIG. 1 according to various embodiments of the present invention.
Figure 9B:
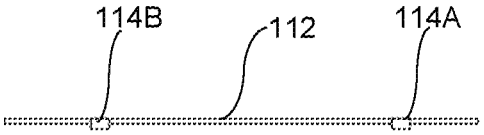
Figure 9C:
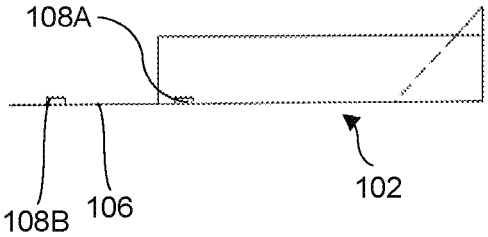

FIGS. 9A-C shows a top view of the color board, a side view of the color board and a side view of the foil strip holder with the two magnetic regions on the colored board interface extension region of FIG. 1 according to various embodiments of the present invention. FIG. 9A is the top view of the color board 112, showing the two magnetic areas 114A-B. FIG. 9B is the side view of the color board 112 with the two magnetic areas 114A-B on the bottom. FIG. 9C shows side view of the foil strip holder 102 with the two magnetic regions 108A-B on the colored board interface extension region 106 being shown.

Figure 10A:
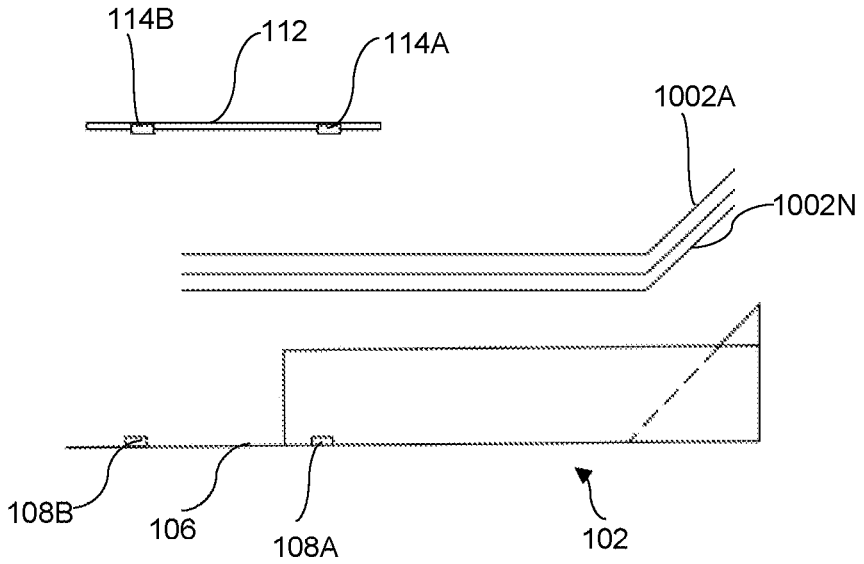
FIGS. 10A-B-FIGS. 10A-B shows a composite view of the side views of the color board and the foil strip holder with the plurality of foil strips of FIG. 1 according to various embodiments of the present invention.
Figure 10B:
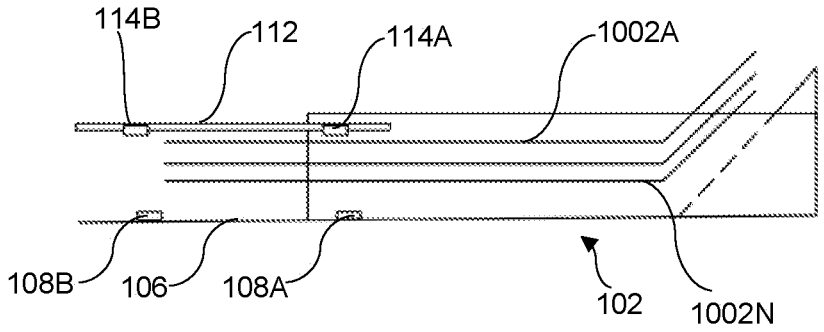

FIGS. 10A-B shows a composite view of the side views of the color board and the foil strip holder with the plurality of foil strips of FIG. 1 according to various embodiments of the present invention. FIG. 10A shows a side view of the color board 112 with two magnetic areas 114A-B on the bottom and a side view of the foil strip holder 102 with the two magnetic regions 108A-B of the color board interface extension region 106. FIG. 10A also shows a graphic showing plurality of foil strips 1002A-N. FIG. 10B shows how the foil strip holder 102 then can have the plurality of the foil strips 1002A-N interspersed between a bottom of the foil strip holder 102 and on the top, have it engaged with the color board 112. The two magnetic regions 108A-B of the color board interface extension region 106 are dimensionally aligned with the two magnetic areas 114A-B on the bottom surface of the color board 112.

Figure 11A:
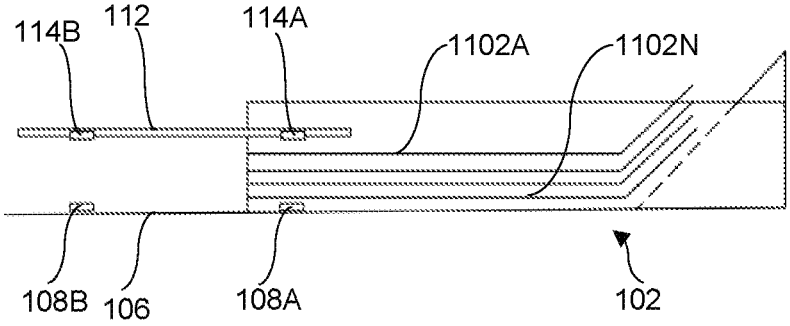
FIGS. 11A-C-FIGS. 11A-C illustrate a composite view of the color board preparation with a foil strip, designed for use during the hair styling process, in accordance with various embodiments of the present invention.
Figure 11B:
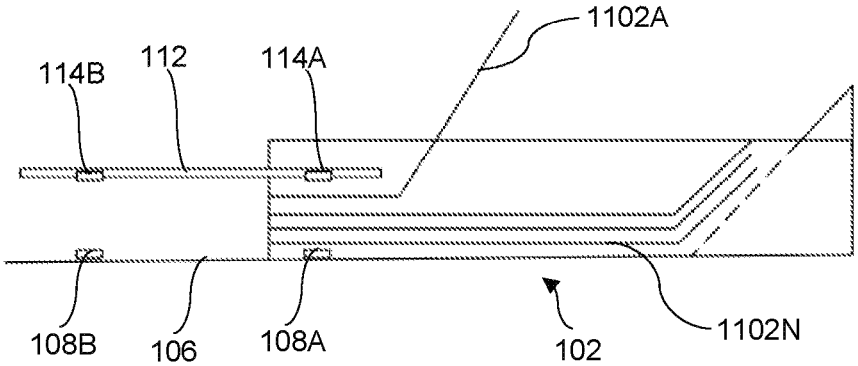
Figure 11C:
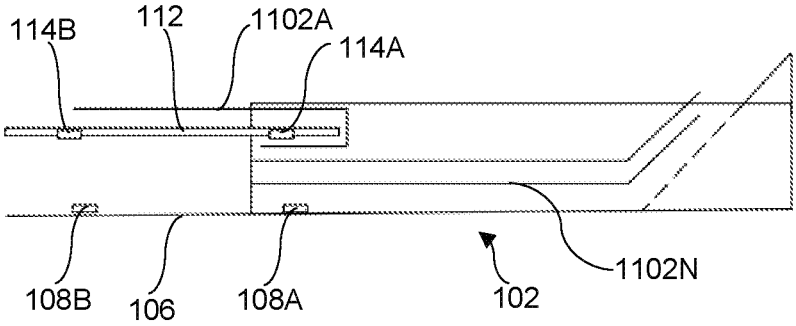

FIGS. 11A-C illustrate a composite view of the color board preparation with a foil strip, designed for use during the hair styling process, in accordance with various embodiments of the present invention. FIGS. 11A-C shows a composite view where the plurality of the foil strips 1102A-N is placed within the foil strip holder 102, the color board 112 is placed on top, sandwiching the plurality of the foil strips 1102A-N. The magnetic regions 108A-B and the magnetic areas 114A-B of the respective color board 112 and the foil strip hold on a line. FIG. 11A, shows the first step in which a single sheet or a foil strip is then removed from the stack and begins to fold over the actual color board 112. FIG. 11B, shows commencement of the folding of the foil strip 1102A over the actual color board 112. FIG. 11C shows the actual single foil strip 1102A then be folded over the color board 112 in preparation for the color board 112 to be removed from the engagement with the device 100 in order for the hair stylist to go ahead and then utilize that during the hair styling process.

Figure 12A:
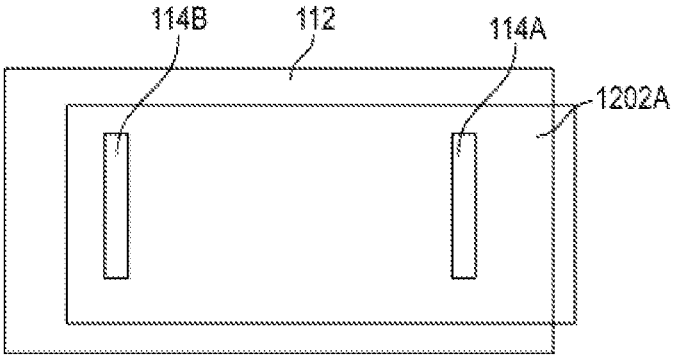
FIGS. 12A-B-FIGS. 12A-B show a top view and a side view of a foil strip folded over the color board of FIG. 1 according to various embodiments of the present invention.
Figure 12B:
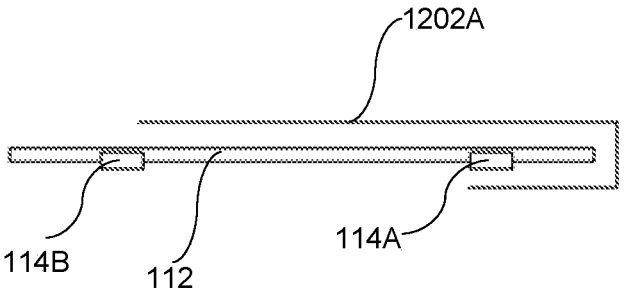

FIGS. 12A-B show a top view and a side view of a foil strip folded over the color board of FIG. 1 according to various embodiments of the present invention. FIG. 12A shows a top view of a foil strip 1202A folded over the color board 112. FIG. 12B shows a side view of the foil strip 1202A folded over the color board 112.

While the present invention has been described in terms of particular embodiments and applications, in both summarized and detailed forms, it is not intended that these descriptions in any way limit its scope to any such embodiments and applications. It will be understood that many substitutions, changes and variations in the described embodiments, applications and details of the method and system illustrated herein and of their operation can be made by those skilled in the art without departing from the spirit of this invention.

While the present invention has been described in terms of particular embodiments and applications, in both summarized and detailed forms, it is not intended that these descriptions in any way limit its scope to any such embodiments and applications. It will be understood that many substitutions, changes and variations in the described embodiments, applications and details of the method and system illustrated herein and of their operation can be made by those skilled in the art without departing from the spirit of this invention.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

The present invention has been described with reference to the preferred embodiments, it should be noted and understood that various modifications and variations can be crafted by those skilled in the art without departing from the scope and spirit of the invention. Accordingly, the foregoing disclosure should be interpreted as illustrative only and is not to be interpreted in a limiting sense. Further it is intended that any other embodiments of the present invention that result from any changes in application or method of use or operation, method of implementation which are not specified within the detailed written description or illustrations contained herein are considered within the scope of the present invention.

Insofar as the description above and the accompanying drawings disclose any additional subject matter that is not within the scope of the claims below, the inventions are not dedicated to the public and the right to file one or more applications to claim such additional inventions is reserved.

What is claimed is:

1. A hair coloring assistance device suitable for assisting in hair coloring and foil highlighting processes configured for functionality for a one hand operation, wherein the device comprises, a foil strip holder having a substantially U-shaped cross-section with a flat bottom, a top surface, two opposing walls extending vertically from the flat bottom, and a color board interface extension region with two magnetic regions, and wherein the color board interface extension is configured with two foil strip stops positionable on the top surface;

a color board configured to interface with the foil strip holder and arranged to be positionable on the top surface of the foil strip holder and to engage with the color board interface extension region of the foil strip holder with the magnetic regions and having at least two magnetic areas on a bottom surface of the color board wherein the at least two magnetic areas are dimensionally configured to align with the two magnetic regions on the top surface of the foil strip holder; and wherein when a plurality of foil strips are placed onto the foil strip holder and the color board is placed onto the color board interface extension region and wherein the plurality of foil strips are interspersed between the top surface of the foil strip holder and the bottom surface of the color board and the plurality of foil strips are maintained onto a position on the hair coloring assistance device by the structure of the two foil strip stops, the color board when placed onto the hair styling assistance device and wherein the magnetic regions of the foil strip holder engage with the magnetic areas of the color board, a hair styling professional can execute a single-handed operation of placement of a single foil strip of the plurality of foil strips placed onto the foil strip holder onto the color board for use during hair coloring processes.

2. The device of claim 1, comprising a wedge configured to be positioned on the top surface of the foil strip holder structured to provide an angle from a horizontal angle and arranged to allow the hair stylizing professional to manually grab a single foil strip from the plurality of foil strips and, with a one hand operation, fold an end of the single foil strip over an end of the color board.

3. The device of claim 2, wherein the wedge is removably attached to the foil strip holder using hook-and-loop fasteners.

4. The device of claim 2, wherein the color board includes the at least two magnetic areas being two magnetic attachments, with a first magnetic attachment located near an upper lateral edge of the color board and a second magnetic attachment positioned lower than the first magnetic attachment.

5. The device of claim 4, wherein the two magnetic attachments on the color board and at least one magnetic attachment of the wedge are configured to selectively attach to each other at multiple positions to adjust the height of the color board within the foil strip holder.

6. The device of claim 2, wherein the wedge includes multiple angled surfaces, allowing for reversible positioning to provide different angles of tilt for the color board.

7. The device of claim 2, wherein the wedge is configured with an adjustable angle to regulate the tilt of the color board and the stack of foil sheets during use.

8. The device of claim 2, wherein the wedge is sized to substantially fill the space between the two opposing walls of the foil strip holder, limiting lateral movement of the wedge.

9. The device of claim 1, further comprising a base attached to the bottom of the foil strip holder, the base configured to pivot around a vertical axis.

10. The device of claim 9, wherein the base is removable and includes suction cups, felt pads, magnetic connection devices, adhesives, locking surface devices, or sliding pads to secure or protect the surface on which the foil strip holder is placed.

11. The device of claim 1, wherein the foil strip holder, the wedge, and the color board are constructed from a lightweight, washable, and chemical-resistant materials, selected from carbon fiber, plastic, plexiglass, or wood.

12. The device of claim 1, wherein the foil strip holder includes adjustable walls to accommodate color boards of varying widths.

13. The device of claim 1, wherein the device further comprises legs or supports attached to the foil strip holder, the legs or supports configured to include suction cups, felt pads, or wheels.

14. The device of claim 13, wherein the legs or supports include at least three wheels, with at least one wheel being pivotable.

15. The device of claim 1, wherein the color board includes repositionable magnetic attachments configured to be adjusted along the board using a hook-and-loop mechanism.

* * * * *